United States Patent [19]

Lin

[11] Patent Number: 4,797,925

[45] Date of Patent: Jan. 10, 1989

[54] METHOD FOR CODING SPEECH AT LOW BIT RATES

[75] Inventor: Daniel Lin, Montville Township, Morris County, N.J.

[73] Assignee: Bell Communications Research, Inc., Livingston, N.J.

[21] Appl. No.: 911,776

[22] Filed: Sep. 26, 1986

[51] Int. Cl.[4] ..... G10L 5/00

[52] U.S. Cl. ..... 381/36; 381/31; 381/34

[58] Field of Search ..... 381/29-36

[56] References Cited

U.S. PATENT DOCUMENTS

| | | | |
|---|---|---|---|
| 4,360,708 | 11/1982 | Taguchi et al. | 381/36 |
| 4,535,472 | 8/1985 | Tomcik | 381/34 |
| 4,610,022 | 9/1986 | Kitayama et al. | 381/36 |
| 4,672,670 | 6/1987 | Wang et al. | 381/36 X |
| 4,677,671 | 6/1987 | Galand et al. | 381/31 |

OTHER PUBLICATIONS

Schroeder et al., "Stochastic Coding of Speech at Very Low Bit Rates: The Importance of Speech Perception," *Speed Communication 4* (1985), North-Holland, pp. 155-162.

Schroeder et al., "Code Excited Linear Prediction (CELP): High-Quality Speech at Very Low Bit Rates," *IEEE*, 1985, pp. 937-940.

Atal et al., "Adaptive Predictive Coding of Speech Signals," *Bell System Technical Journal*, vol. 49, pp. 1973-1986, Oct., 1970.

Atal et al., "Predictive Coding of Speech at Low Bit Rates," IEEE Trans. Commun., vol. COM-30, 1982, pp. 600-614.

Singhal et al., "Improving Performance of Multi-Pulse LPC Coders at Low Bit Rates," Proc. Int. Conf. on Acoustics, Speech, and Signal Proc., vol. 1, paper No. 1.3, Mar. 1984.

*Primary Examiner*—Patrick R. Salce
*Assistant Examiner*—Marc S. Hoff
*Attorney, Agent, or Firm*—James W. Falk

[57] ABSTRACT

A method for coding speech at low bit rates is disclosed. As compared to the well known stochastic coding method, the method of the present invention requires substantially less computational resources. The reduction of required resources is achieved by utilizing a set of code sequences in which each code sequence is related to the previous code sequence. For example, each succeeding code sequence may be derived from the previous code sequence by removing one or more elements from the beginning of the previous sequence, and adding one or more elements to the end of the previous sequence.

8 Claims, 1 Drawing Sheet

METHOD FOR CODING SPEECH AT LOW BIT RATES

FIELD OF THE INVENTION

The present invention relates to a method for coding speech.

BACKGROUND OF THE INVENTION

The ability to code speech at low bit rates without sacrificing voice quality is becoming increasingly important in the new digital communications environment. Efficient speech coding methods will determine the success of numerous new applications such as digital encyrption, mobile telephony, voice mail, and speech transmission over packet networks. Speech coding technology for voice quality is now well developed for bit rates as low as 16 kilobits/sec. (This means that 16 kilobits of data are required to code 1 sec. of speech.) Research is now focusing on achieving substantially lower rates, i.e. rates below 9.6 kilobits/sec. It is a major challenge in present applied speech research to achieve low bit rates without degrading speech quality.

One method for coding speech at relatively low bit rates is known as stochastic coding (see for example, Schroeder et al. "Stochastic Coding Of Speech At Very Low Bit Rates, The Importance Of Speech Perception", *Speech Communication* 4, (1985), 155–162, and Schroeder et al. "Code Excited Linear Prediction (CELP): High Quality Speech At Very Low Bit Rates", *IEEE*, 1985).

In the stochastic coding method, an analog speech signal to be coded is first sampled at the Nyquist rate (e.g. about 8 kilohertz). The resulting train of samples is then broken-up into short blocks which are stored, each block representing, for example, 5 milliseconds of speech. Illustratively, each block of speech contains 40 samples. The actual speech signal is then coded block by block.

To use stochastic coding, for each block of speech to be coded, 1024 random code sequences are generated. Each random code sequence is multiplied by an amplitude factor and processed by two linear digital filters with time varying filter coefficients. After being processed in the foregoing manner, each code sequence is compared to the block of speech to be coded, and the code sequence which is closest to the actual block of speech is identified. An identification number for the chosen code sequence and information about the amplitude factor and filter coefficients are transmitted from the coder to the receiver.

More particularly, it is well known that a reasonable model for the production of human speech sounds may be obtained by representing human speech as the output of a time varying linear digital filter which is excited by a quasi-periodic pulse train (see for example Atal et al "Adaptive Predictive Coding of Speech Signals", *Bell System Technical Journal*, vol. 49, pp 1973–1986, Oct. 1970). The output of the digital filter at any sampling instant is a linear combination of the past p output samples and the present input sample.

A digital filter may be represented as a feedback loop which includes a tapped delay line. This delay line comprises a plurality of discrete delays of fixed duration related to the sampling interval mentioned above. Taps are located at uniform intervals along the delay line. The output of each tap is multiplied by a filter coefficient. After multiplication by the filter coefficients, the resulting tap outputs and the present input sample are added to form the filter output. In mathematical terms, the input to the filter is a sequence of weighted impulses. The output of the filter is also a sequence of weighted impulses, each output impulse being formed by adding the delayed outputs from the taps and the present input impulse as described above. The filter may be made time varying by utilizing time dependent filter coefficients.

In the stochastic coding method, a block of speech which illustratively comprises 40 samples may be coded as follows: First, 1024 random code sequences are generated by a code generator. Each sequence contains, for example, 40 elements or samples. After generation, each code sequence is multiplied by an amplitude factor which depends on the amplitudes in the actual block of speech to be coded. Thus, the amplitude factor is adjusted for each block of speech to be coded. After multiplication by the amplification factor, each code sequence is passed through two time varying linear digital filters of the type described above.

As set forth in the references mentioned above, the first filter includes a long delay predictor in its feedback loop and the second filter includes a short delay predictor in its feedback loop. Physically, the first filter generates the pitch periodicity of the human vocal cords and the second filter generates the filtering action of the human vocal track (e.g. mouth, tongue and lips).

The filter coefficients are changed for each block of actual speech to be coded (but not for each code sequence), in accordance with an algorithm known as adaptive predictive coding. This algorithm is discussed in the above-mentioned references and in B. S. Atal "Predictive Coding of Speech at Low Bit Rates", IEEE Trans. Commun. Vol. COM-30, 1982, pp 600–614, and S. Singhal et al "Improving Performance of Multi-pulse LPC Coders at Low Bit Rates", Proc. Int. Conf. on Acoustics, Speech, and Signal Proc., Vol. 1, paper No. 1.3, March 1984.

After multiplication by the amplitude factor and processing by the two digital filters, each of the 1024 random code sequences is successively compared with the actual block of speech to be coded. The processed code sequence which is closest to the actual block of speech is identified. A 10-bit identification number identifying the chosen code sequence and information relating to the amplitude factor and the filter coefficients are then transmitted from the coding device to the receiver. Upon receipt of this information, the receiver retrieves the chosen code sequence from its memory, multiplies the chosen sequence by the transmitted amplitude factor and processes the chosen code sequence through two digital filters using the transmitted filter coefficients to reproduce the actual speech signal.

Using the above described stochastic coding method, high quality synthetic speech has been produced at bit rates as low as 4.8 kilobits/sec. However, computationally, the stochastic coding method is very expensive. According to the foregoing references, it takes 125 sec. of Cray-1 CPU time to process 1 sec. of speech signal. To look at this another way, if one second of actual speech signal is divided-up into 200 five millisecond blocks of 40 samples each, and each of the 1024 random code sequence comprises 40 elements, and the two filters have a total of 19 taps, then the filtering of operations required to code 1 sec. of actual speech, involve $19 \times 40 \times 1024 \times 200 = 155{,}648{,}000$ separate computational steps (i.e., multiplies and adds).

Thus, the stochastic coding technique is not particularly suitable for commercial applications. Accordingly, it is an object of the present invention to provide a method for coding speech which, like stochastic coding, achieves bit rates in the 4.8 kilobits/sec range, but which requires significantly less computational resources.

SUMMARY OF THE INVENTION

The present invention is a method for coding speech at rates in the 4.8 kilobit/sec range. The inventive method requires about 90% less computational resources than the stochastic coding method described above.

This reduction is achieved, by eliminating the use of a set of (e.g. 1024) stored random code sequences, and substituting a set of code sequences in which each succeeding sequence is related to the previous sequence. Illustratively, each succeeding code sequence may be generated from the previous code sequence by removing one or more elements from the beginning of the previous sequence and adding one or more elements to the end of the previous sequence. The coding method of the present invention is expected to have real time and greater than real time application.

DETAILED DESCRIPTION

Figure 1:
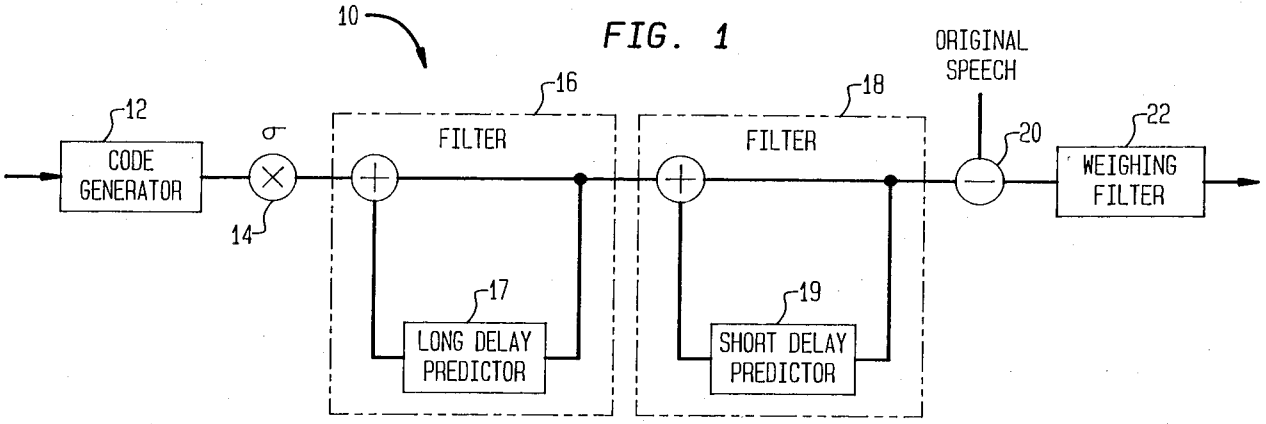
FIG. 1 schematically illustrates a speech coding device capable of coding speech at bit rates in the 4.8 kilobits/sec range, in accordance with an illustrative embodiment of the present invention.

Turning to FIG. 1, a coding device 10 for coding speech signals is schematically illustrated. The coded speech signal is to be transmitted to a speech decoding device 30 of FIG. 2. Before being coded by the coding device of FIG. 1, an analog speech signal is first sampled at the Nyquist rate (e.g. 8 KHz). The resulting signal comprises a train of samples of varying amplitudes. The train of samples is divided into blocks which are stored. Illustratively, each block has a duration of 5 milliseconds and contains 40 samples. The speech signal is coded on a block-by-block basis using the coding device 10 of FIG. 1.

Illustratively, the code generator 12 stores 1024 code sequences, each code sequence comprising 40 elements. For each block of actual speech signal to be coded, the code generator 12 generates the 1024 code sequences. Each code sequence is multiplied by an amplitude factor $\sigma$ using multiplication element 14. The amplitude factor $\sigma$ is determined from the amplitudes of the samples contained in the actual block of speech to be coded.

After multiplication by the amplitude factor, each code sequence is processed by two linear digital filters 16, 18. The filter 16 includes a tapped delay line 17 in its feedback loop which forms a long delay predictor. Illustratively, the long delay predictor has 3 taps. The filter 18 includes a tapped delay line 19 in its feedback loop which forms a short delay predictor. Illustratively, the short delay predictor has 16 taps. Thus, each digital filter illustratively may be of the type described in the McGraw Hill Encyclopedia of Electronics and Computers, McGraw Hill, Inc. 1982, pg. 265. As indicated above, the filter 16 generates the pitch periodicity of the human vocal cords and the filter 18 generates the filtering action of the human vocal track (e.g., mouth, tongue, lips). The filter coefficients in the filters 16 and 18 are changed for each block of actual speech signal to be coded in accordance with the adaptive predictive coding algorithm discussed above. When the adaptive predictive coding algorithm is used, the filter coefficients (i.e., the multiplication factors at the tap outputs) depend on the block of actual speech signal to be coded and thus change for each block of actual speech signal to be coded.

After multiplication by the amplitude factor $\sigma$ and processing by the digital filters 16 and 18, each code sequence is compared with the block of actual speech signal to be coded by using subtraction element 20. Filter 22 is utilized to produce a frequency weighted mean square error between each processed code sequence and the block of actual speech signal to be coded. The code sequence which minimizes this error is identified.

Figure 2:
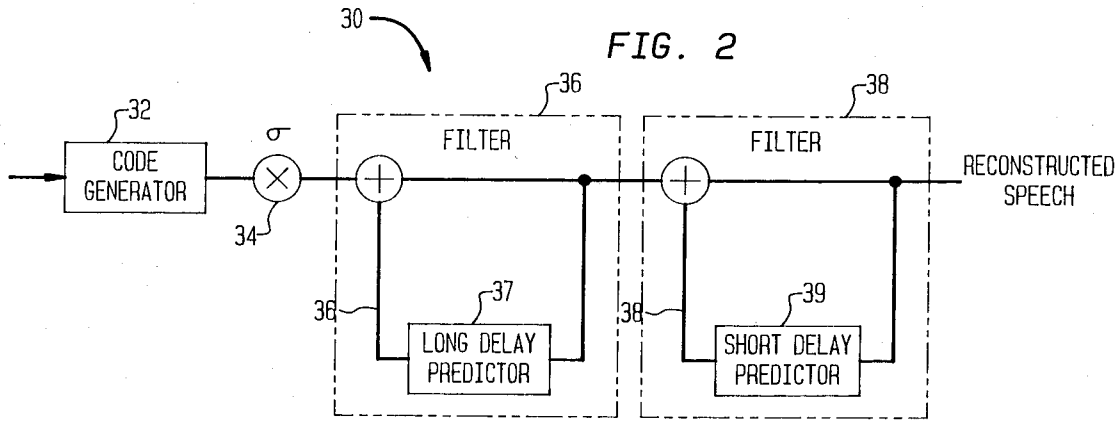
FIG. 2 schematically illustrates a speech decoder capable of decoding speech signals coded using the device of FIG. 1.

Thus, to transmit a block of speech from the coding device 10 of FIG. 1 to the receiving device 30 of FIG. 2, an identification number for the error minimizing code sequence is transmitted to the receiving device 30, along with information identifying the amplitude factor and the filter coefficients. In the receiver 30, the code generator 32 regenerates the code sequence identified by the transmitted identification number. The regenerated code sequence is multiplied by the transmitted amplitude factor $\sigma$ using multiplication element 34 and is processed by the time varying linear digital filters 36 and 38 to produce the reconstructed speech signal. Illustratively, the filters 36 and 38 are identical to the filters 16 and 18 respectively. As indicated above, the filter coefficients for the filters 36 and 38 are transmitted from the coding device 10 to the receiving decoder 30 for each block of coded speech, along with a code sequence identification number and amplitude factor.

In the prior art stochastic coding method, for each block of actual speech signal to be coded, the code generator 12 in the coding device 10 of FIG. 1 generates 1024 random code sequences. For this reason, it takes about 125 sec. of Cray-1 CPU time to code one sec of speech. As indicated above, steps in the schochastic coding method use of two digital filters with a total of nineteen taps may involve up to 155 million computational steps for each second of speech to be coded.

Illustratively, in the present invention, the code generator 12 generates 1024 related code sequences. Each code sequence contains 40 samples or elements. Typically, each succeeding code sequence may be derived from the preceding code sequence by removing one element from the beginning of and adding one element to the end of the preceding code sequence.

The code sequences may be represented as follows:

| | |
|---|---|
| Sequence 1 | $u_1, u_2, u_3 \ldots u_{40}$ |
| Sequence 2 | $u_2, u_3, u_4 \ldots u_{41}$ |
| Sequence 3 | $u_3, u_4, u_5 \ldots u_{42}$ |
| Sequence 4 | $u_4, u_5, u_6 \ldots u_{43}$ |
| . | . |
| . | . |
| . | . |
| Sequence 1024 | $u_{1024}, u_{1025}, u_{1026} \ldots u_{1063}$ |

Thus, each succeeding sequence is formed by eliminating the first element of the preceding sequence and adding a new element at the end of the sequence.

The 1024 related code sequences of the present invention are formed from only 1063 numbers $u_1, u_2, \ldots u_{1063}$. The 1063 elements may be chosen randomly. In contrast, in the prior art stochastic coding method, to generate 1024 random code sequences, each containing 40 elements, $1024 \times 40 = 40{,}960$ random number elements are required. Thus, use of the present invention, significantly reduces the amount of memory required to store the code sequences.

As is shown below, use of the above-identified related code sequences leads to a significant reduction in the computational resources required to code each second of speech.

Let $$\{h_n\}\Big|_{n=1}^{40} = h_1, h_2 \ldots h_{40}$$

be a forty sample sequence of unit response of the cascaded filters 16 and 18. This response is achieved by driving the filters 16 and 18 with a unit sample followed by 39 zero samples.

The 40 sample filter response to each of the code elements $u_1, u_2, u_3 \ldots u_{1063}$ which form the 1024 code sequences may be represented as $$\left\{ V_n^j \right\}\Big|_{j=1}^{1063}\Big|_{n=1}^{40}$$

where $$V_1^1, V_2^1, V_3^1, \ldots V_{40}^1 = u_1(h_1, h_2, \ldots h_{40})$$

$$V_1^2, V_2^2, V_3^2, \ldots V_{40}^2 = u_2(h_1, h_2, \ldots h_{40})$$

$$V_1^3, V_2^3, V_3^3, \ldots V_{40}^3 = u_3(h_1, h_2, \ldots h_{40})$$

$$\vdots$$

$$V_1^j, V_2^j, V_3^j, \ldots V_{40}^j = u_j(h_1, h_2, \ldots h_{40})$$

$$\vdots$$

$$V_1^{1063}, V_2^{1063}, V_3^{1063}, \ldots V_{40}^{1063} = u_{1063}(h_1, h_2, \ldots h_{40})$$

Thus a particular 40 element sequence $$V_1^j, V_2^5, V_3^j, \ldots V_{40}^j$$

is the response of the cacaded filters 16,18 to the code element $u_j$ located at sample 1 follwed by 39 zeroes.

The array $\{V_n^j\}$ may now be rewritten so that each succeeding row is shifted one position to the right.

$$V_1^1, V_2^1, V_3^1 \ldots V_{40}^1$$

$$V_1^2, V_2^2 \ldots V_{40}^2$$

$$V_1^3, V_2^3 \ldots V_{40}^3$$

$$\vdots$$

The columns in this array are now added to form the set $$\{w_j\}\Big|_{j=1}^{1013}$$

$$w_1 = V_1^1$$

$$w_2 = V_2^1 + V_1^2$$

$$w_3 = V_3^1 + V_2^2 + V_1^3$$

$$\vdots$$

$$w_{1063} = V_{40}^{1063}$$

The sequence $w_1, w_2 \ldots w_{40}$ is the 40 sample response of the cascaded filters 16, 18 to the input $u_1, u_2, u_3 \ldots u_{40}$ which is the first code sequence produced by the code generator 12. Similarly, $$w_2 - V_2^1, w_3 - V_3^1, w_4 - V_4^1, \ldots w_{40} - V_{40}^1, w_{41}$$

is the filter response to the second code sequence $u_2, u_3 \ldots u_{41}$. (This is obtained from the filter response to the first code sequence by subtracting out the 40 sample filter response $V_1^j, V_2^j, V_3^j \ldots V_{40}^j$ to the input code element $u_1$ which is not present in the second code sequence, shifting one place to the right to eliminate the left most term and appending $w_{41}$ to the end of the sequence).

In general, as indicated above, each succeeding code sequence is generated from the preceding code sequence by deleting one element from the beginning of and adding one element to the end of the preceding sequence. Thus, the filter response to each succeeding code sequence may be generated from the filter response to the preceding code sequence by subtracting out the 40 sample filter response to the deleted code element, shifting one sample to the right (i.e., eliminating the first term), and appending the next member of the set $\{w_n\}$.

The computational requirement for obtaining the outputs of the cascaded filters 16, 18 in response to the 1024 related code sequences is (1) $40 \times 1024 = 40{,}960$ multiplies and adds to generate the set $\{w_n\}$, and (2) 40 subtractions to generate each of the succeeding 1024 filter responses from the preceding filter response for a total of 40,960 subtractions.

Thus, 81,920 arithmetic operations are required to obtain the filter outputs necessary to code each 5 millisecond block of speech. To encode one second of speech using the method disclosed herein 16,384,000 operations are required to obtain the filter outputs. This is an approximately 90% reduction over the approximately 155,684,000 operations required to obtain the filter outputs for each second of speech to be coded using the prior art stochastic coding method.

The number of operations required to encode a block of speech may be further reduced by forming the 1024 sequences, primarily from −1's, 0's and 1's so that each sequence has a mean near 0 and a variation of about 1. In this case, the array $\{V_n^j\}$ has a significant number of zeroes. This substantially reduces the number of substractions needed to obtain the filter responses for the 1024 related input code sequences.

Finally, the above-described embodiment of the invention are intended to be illustrative only. Numerous alternative embodiments may be devised without departing from the spirit and scope of the following claims.

What is claimed is:

1. A method for coding a block of a speech signal comprising the steps of:

generating a set of related code sequences, wherein within said set each succeeding code sequence is generated from the preceding code sequence by removing one or more elements from the beginning of and adding one or more elements to the need of the preceding code sequence, processing each code sequence by applying each code sequence to at least one digital filter, and comparing each processed code sequence with said block of speech signal to determine which processed code sequence is closest to said block of speech signal.

2. The method of claim 1, wherein said method further includes the step of transmitting to a receiver information identifying the code sequence which is closest to said block of speech signal.

3. The method of claim 1, wherein said processing step further includes the step of multiplying each code sequence by an amplitude factor.

4. The method of claim 1, wherein said processing step comprises the step of applying each code sequence to a time varying digital filter.

5. The method of claim 1, wherein each of said related sequences is formed from electrical samples representing values of −1's, 0's, and 1's.

6. A method for coding and decoding a speech signal comprising the steps of, dividing the speech signal into blocks, each block comprising a plurality of samples, for each block of speech signal to be coded, generating a set of related code sequences, each succeeding code sequence being generated from the preceding code sequence by removing one or more elements from the beginning of and adding one or more elements to the end of the preceding sequence, processing each code sequence by multiplying each code sequence by an amplitude factor and passing each sequence through at least one digital filter with time varying filter coefficients, comparing each processed code sequence with the actual block of speech signal to be coded to determine which processed code sequence is closest to the actual block of speech signal, transmitting to a receiver an identification number of the closest code sequence and information relating to said amplitude factor and filter coefficients, and receiving said identification number and said information at said receiver, and in response thereto, regenerating said code sequence identified by said number, multiplying said regenerated code sequence by said amplitude factor and passing said regenerated code sequence through at least one digital filter whose filter coefficients are determined using said received information, thereby regenerating the coded speech signal.

7. An apparatus for coding a block of speech signal comprising:

means for generating a set of related code sequences in which each succeeding code sequence is generated from the preceding code sequence by removing one or more elements from the beginning and adding one or more elements to the end of the preceding sequence, means including an amplitude multiplication element and at least one digital filter for processing each code sequence, and means for comparing each processed code sequence with said block of speech signal to determine which processed code sequence is closest to the block of speech signal.

8. A method for coding a block of speech signal comprising the steps of:

generating a set of related code sequences, wherein within said set each succeeding code sequence is generated from the preceding code sequence by removing one or more elements from one end of and adding one or more elements to the other end of the preceding code sequence, processing each code sequence by multiplying each code sequence by an amplitude factor and applying each code sequence to at least one digital filter with time varying coefficients, and comparing each processed code sequence with said block of speech signal to determine which processed code sequence is closest to said block of speech signal.

* * * * *